US007815483B2

(12) United States Patent
Egendorf

(10) Patent No.: US 7,815,483 B2
(45) Date of Patent: Oct. 19, 2010

(54) SOFT SCULPTURE AND METHOD OF MAKING THE SAME

(76) Inventor: Linda Egendorf, P.O. Box 713, Lincoln, MA (US) 01773

( * ) Notice: Subject to any disclaimer, the term of this patent is extended or adjusted under 35 U.S.C. 154(b) by 976 days.

(21) Appl. No.: 11/390,503

(22) Filed: Mar. 27, 2006

(65) Prior Publication Data

US 2007/0221064 A1 Sep. 27, 2007

(51) Int. Cl.
*A63H 33/04* (2006.01)

(52) U.S. Cl. ..... 446/85; 446/99

(58) Field of Classification Search ..... 446/85
See application file for complete search history.

(56) References Cited

U.S. PATENT DOCUMENTS 4,722,712 A * 2/1988 McKenna ..... 446/92
5,964,634 A * 10/1999 Chang ..... 446/85

* cited by examiner

*Primary Examiner*—Robert A Hopkins
(74) *Attorney, Agent, or Firm*—Fish & Richardson P.C.

(57) ABSTRACT

A method of creating a soft sculpture by assembling a plurality of compositional units, wherein each compositional unit comprises a core made of a first material covered by a covering of a second material which covering is held in proximity to the core, either neatly or sloppily, and wherein at least two of the plurality of compositional units are connected to each other.

19 Claims, 4 Drawing Sheets

SOFT SCULPTURE AND METHOD OF MAKING THE SAME

BACKGROUND OF THE INVENTION

The present invention relates to the field of sculpture, and concerns both a novel form of sculpture and a novel method of creating such sculptures.

Sculpture is the creation of three-dimensional objects for artistic purposes by the manipulation of materials. The carving of wood, the chiseling of stone, the casting or welding of metal, and the modeling of clay or wax are all examples of sculpting methods. Although wood, stone, metal, clay, and wax are the conventional materials used in sculpture, any material may be used. In addition to using a single material for a sculpture, multiple discrete materials may be used, such as metal-covered plaster. If the material is considered by the artist as soft to the touch, the sculpture may be referred to as soft sculpture, although there is no generally agreed-upon distinction between soft sculpture and other sculpture. Thus, stone, metal, and clay sculptures would not be considered soft sculptures by most artists, but, for example, some paper (e.g., cardboard) and some wax (e.g., beeswax) sculptures might be considered soft sculptures by some artists.

SUMMARY OF THE INVENTION

The present invention concerns sculptures made by the assembly of at least two individual compositional units, each compositional unit consisting of a core covered by a textile-like covering.

The core may be made of any material or materials, including textile-like material or materials, of any shape, and of any size.

The core is covered with at least one textile-like material which either is a textile (e.g., it has been made from thread or fiber by weaving, knitting, or felting), or suede, or presents the appearance of being a textile or suede (e.g., molded fiberglass screening). The covering may be made of any material or materials, for example, acrylic, cotton, Dacron®, fiberglass, leather, linen, metal, nylon, polyester, rayon, suede, wool, or any combination of them. The covering may be partial or it may completely cover the core. The covering may be tight or loose, neat-looking or sloppy-looking. The covering may be attached to the core or may just be held in proximity to it by the geometry of the core and covering, for example, the core may be a sphere of beeswax, and the covering may be a starched cotton fabric covering a full hemisphere and half of the other hemisphere of the core. Attaching may be accomplished by any means compatible with the materials involved, for example, bonding, gluing, nailing, pinning, screwing, sewing, stapling, and welding. Multiple methods of attachment may be used to attach a covering to a core. An attachment of a covering to a core may be visible in the finished sculpture, or not.

The finished sculpture is created by assembly of at least two compositional units into a finished shape. The assembly comprises connecting some or all compositional units to other compositional units with one or more connections. Compositional units which are connected to each other need not be either adjoining or adjacent to each other. Connecting may be accomplished by any means compatible with the materials involved, for example, bonding, gluing, nailing, pinning, screwing, sewing, stapling, and welding. Multiple methods of connecting may be used for connecting one compositional unit to another compositional unit, and different methods of connecting may be used for different connections.

A connection between two compositional units may be visible in the finished sculpture, or not. Similarly, any seams which may exist in the coverings of the individual compositional units may be visible in the finished sculpture, or not.

DETAILED DESCRIPTION OF A PREFERRED EMBODIMENT

A preferred embodiment of the present invention is to make a finished soft sculpture from compositional units of varying sizes by utilizing spherical or nearly spherical cores made of polystyrene, completely or nearly completely covering each core with one or more of various patterns and colors of natural and artificial fiber materials, preferably from articles of discarded clothing, attaching the covering of each compositional unit to its core by pins and/or sewing, and connecting most adjoining compositional units to each other by sewing with thread or dental floss.

Figure 1:
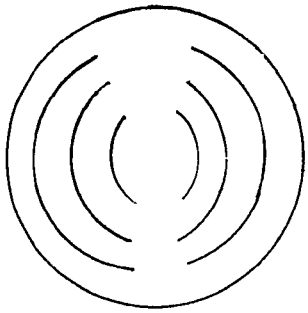
FIGS. 1-4 illustrate four exemplary cores.
Figure 2:
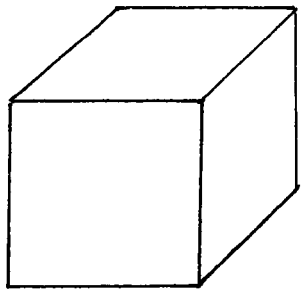
Figure 3:
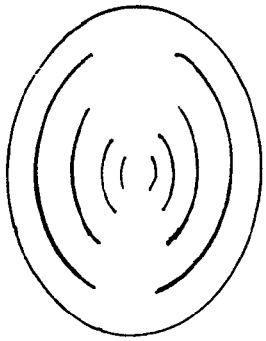
Figure 4:
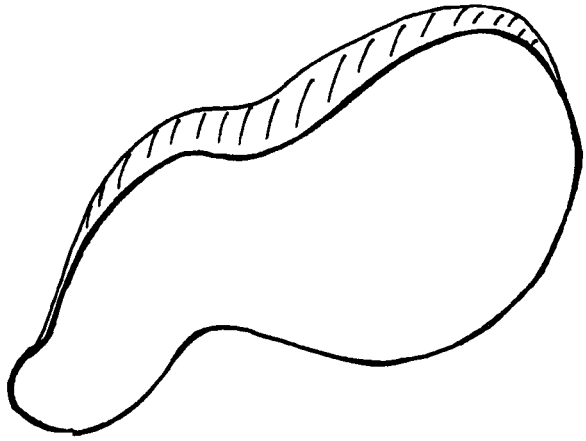

FIGS. 1-4 illustrate several exemplary cores. FIG. 1 represents a spherical core, FIG. 2 represents a cubic core, FIG. 3 represents an ellipsoid core, and FIG. 4 represents a free-form-shaped core. The cores in a sculpture may be of any shape, may be made of any material, and may be of any size. In a preferred embodiment the cores are spherical or nearly spherical, are made of STYROFOAM® (Dow Chemical Company brand of extruded polystyrene), another extruded polystyrene product, or a polystyrene product made from expanded polystyrene beads, and are of varying sizes.

Figure 5:
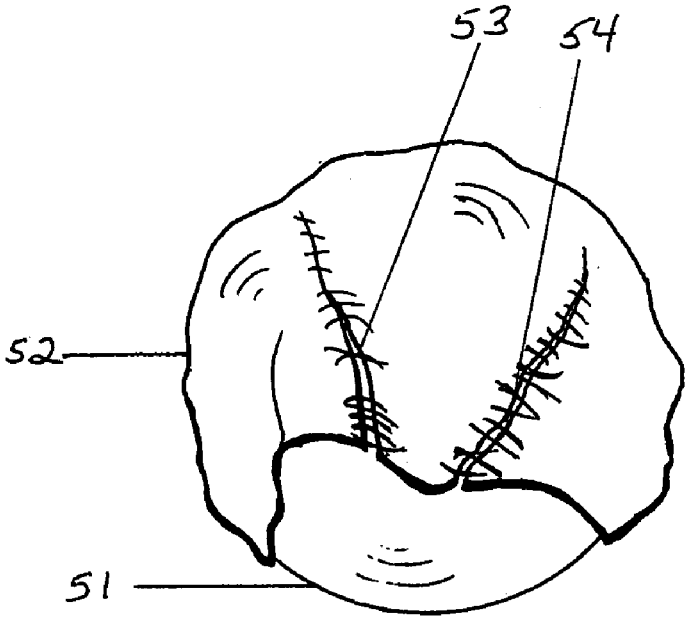
FIGS. 5-6 illustrate two exemplary cores with coverings.
Figure 6:
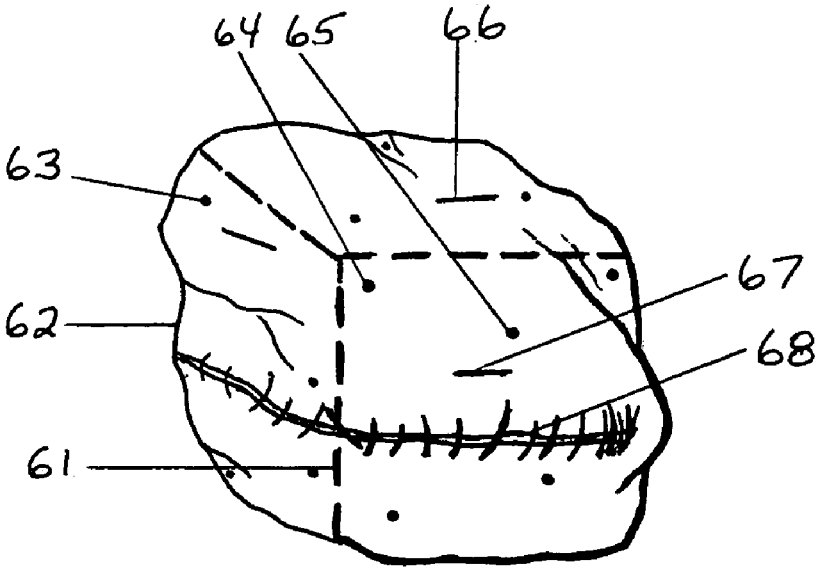

FIGS. 5-6 illustrate exemplary cores with coverings. Spherical core 51 is partially covered by covering 52. Covering 52 is held in proximity to core 51 by the geometries of core 51 and covering 52, and by seams 53 and 54. Covering 52 is held around core 51 but it is not attached to core 51. Covering 52 does not entirely surround core 51. Cubic core 61 is entirely covered by covering 62. Covering 62 is attached to core 61 by, among other attachments, pins 63, 64, and 65, by staples 66 and 67, and contains seam 68. The coverings in a sculpture may be made of any material, may partially or completely cover a core, may be attached to the core or not attached to the core, and, if attached, may be attached by any means compatible with the materials involved. Multiple methods of attachment may be used to attach a covering to a core. In a preferred embodiment the coverings are made from discarded pieces of clothing manufactured from natural and synthetic textiles, entirely or nearly entirely cover their respective cores, and are attached to their respective cores by pinning.

Figure 7:
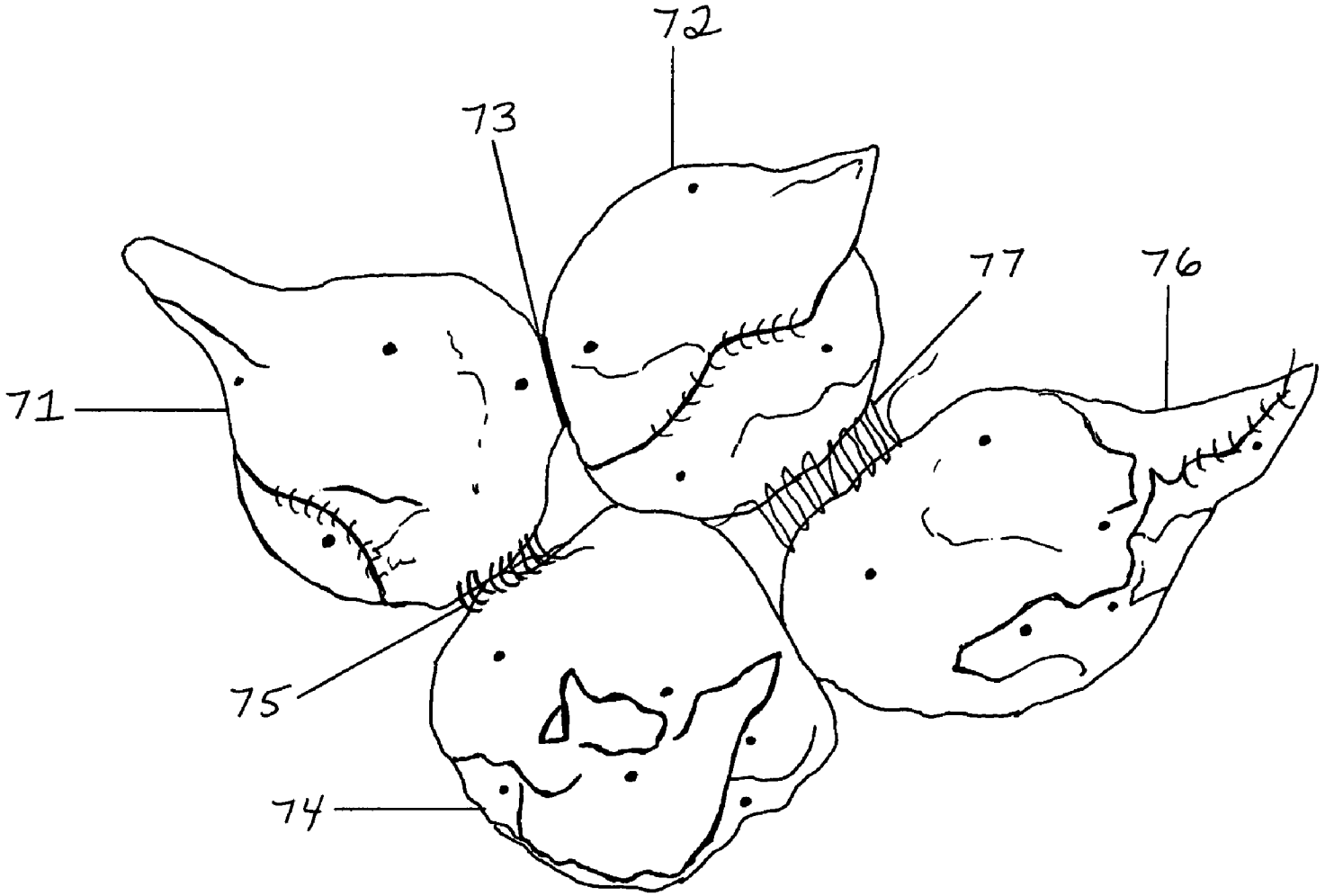
FIG. 7 illustrates some examples of connections between compositional units.

FIG. 7 illustrates examples of connections between compositional units. Compositional units 71 and 72 are glued to each other by connection 73. Compositional units 71 and 74 are sewn together with dental floss connection 75. Compositional units 72 and 74 are adjoining, but are not connected to each other. Compositional units 72 and 76 are adjacent but not adjoining, and are connected to each other with thread connection 77. Each pair of compositional units, whether or not they touch, may be connected to each other, and, if connected, may be connected by any means compatible with the materials involved. Different methods of connection may be used for different connections. In a preferred embodiment only compositional units which touch are connected to each other, and the connections between compositional units are made by sewing with thread or dental floss.

Figure 8:
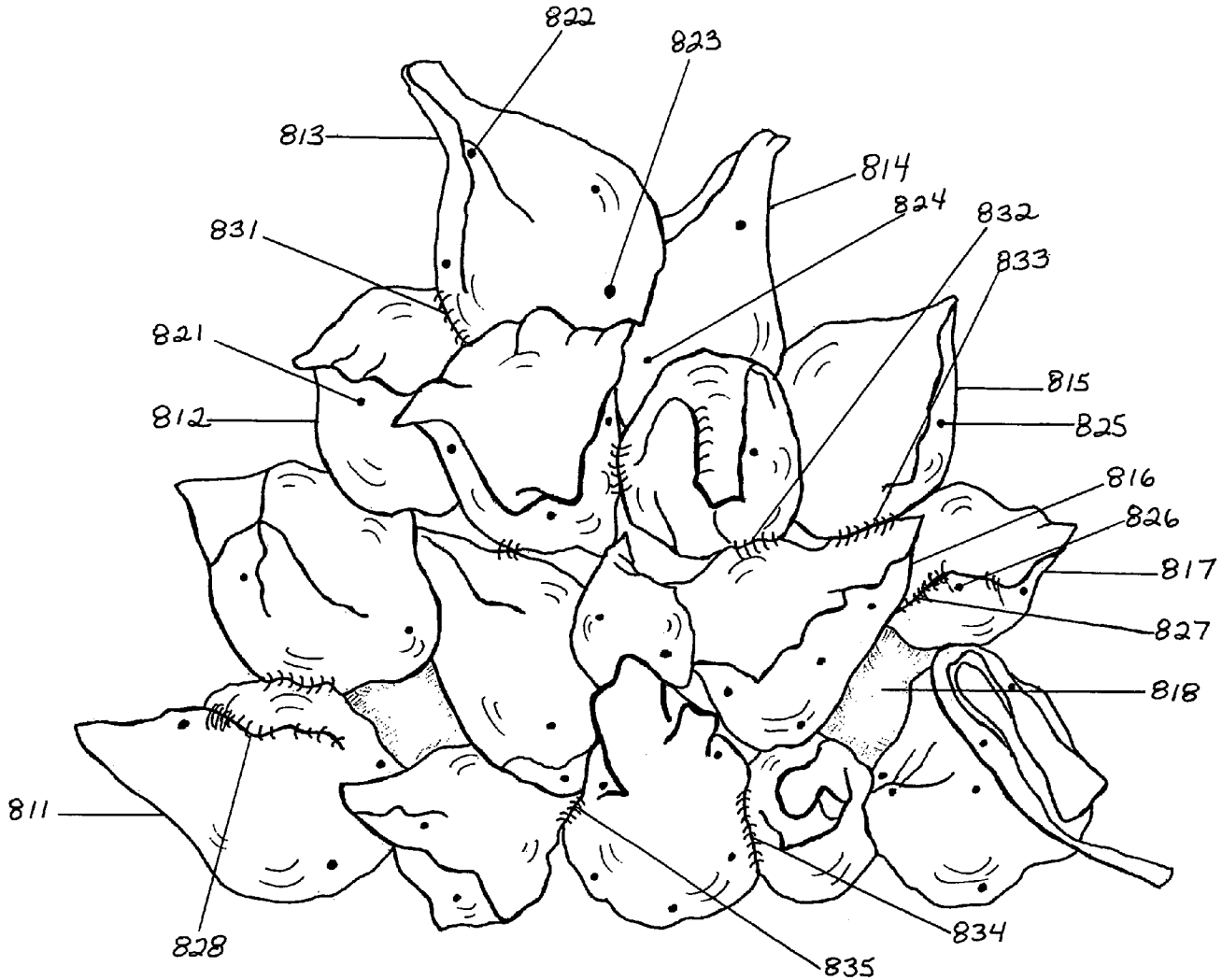
FIG. 8 illustrates an example of a finished sculpture.

FIG. 8 illustrates an example of a finished sculpture. The finished sculpture contains, among others, compositional units 811, 812, 813, 814, 815, 816, 817, and 818, each of which contains a core covered by a covering, some of which are attached by some of pin attachments 821, 822, 823, 824, 825, and 826, and sewn attachments 827 and 828. Some of the pairs of compositional units in the sculpture are held together by connections 831, 832, 833, 834, and 835. In a preferred embodiment, the finished sculpture contains many compositional units of many sizes, each containing a spherical or nearly spherical core. The coverings of the compositional units are of many colors and patterns, are made of natural and artificial fiber materials, preferably from articles of discarded clothing, and are held to their respective cores by pin and sewn attachments, some of which are visible in the finished sculpture. The compositional units are connected to each other by sewn connections using thread and dental floss, some of which are visible in the finished sculpture.

What is claimed is:

1. A method of creating a sculpture comprising:

assembling first, second and third compositional units, wherein each of the first, second and third compositional units comprises:

a core comprised of at least one material; and a covering comprised of at least one material, the covering being held in proximity to the core and covering at least part of the core;

wherein assembling comprises:

arranging the first and second compositional units so that the first and second compositional units border each other;

arranging the first and third compositional units so that the first and third compositional units border each other;

making at least one of the following two connections: (i) connecting a covering of the first compositional unit to a covering of the second compositional unit via a first fastener, and (ii) connecting the covering of the first compositional unit to a covering of the third compositional unit via a second fastener; and arranging the second and third compositional units so that the second and third compositional units touch but are not connected.

2. The method of claim 1, wherein a covering of at least one of the first, second and third compositional units comprises at least one textile.

3. The method of claim 1, wherein each covering is held in proximity to a corresponding core via at least one of bonding, gluing, nailing, pinning, screwing, sewing, stapling, and welding.

4. The method of either claim 1 or claim 2, wherein at least one of the first and second fasteners comprises thread or dental floss.

5. The method of claim 2, wherein a covering is held in proximity to a corresponding core via at least one of bonding, gluing, nailing, pinning, screwing, sewing, stapling, and welding.

6. The method of claim 3 or 5, wherein at least one of the first and second fasteners comprises thread or dental floss.

7. The method of either claim 1 or claim 2, wherein each core is in the shape of at least one of a cube, an ellipsoid, a free-form shape, an ovoid, a sphere, and a spheroid.

8. The method of claim 3 or 5, wherein each core is in the shape of at least one of a cube, an ellipsoid, a free-form shape, an ovoid, a sphere, and a spheroid.

9. The method of claim 4, wherein each core is in the shape of at least one of a cube, an ellipsoid, a free-form shape, an ovoid, a sphere, and a spheroid.

10. The method of claim 6, wherein each core is in the shape of at least one of a cube, an ellipsoid, a free-form shape, an ovoid, a sphere, and a spheroid.

11. The method of claim 1, wherein the first and second fasteners are different types of fastener.

12. The method of claim 1, further comprising:

making both of the following two connections: (i) connecting the covering of the first compositional unit to the covering of the second compositional unit via a first fastener, and (ii) connecting the covering of the first compositional unit to the covering of the third compositional unit via a second fastener.

13. A structure comprising:

first, second and third compositional units, wherein each of the first, second and third compositional units comprises:

a core comprised of a first material; and a covering comprised of a second material, the covering being in proximity to the core and covering at least part of the core;

wherein the first and second compositional units border each other, and the first and third compositional units border each other;

wherein (i) a covering of the first compositional unit is connected to a covering of the second compositional unit via a first fastener and/or (ii) the covering of the first compositional unit is connected to a covering of the third compositional unit via a second fastener; and wherein the second and third compositional units border each other and touch, but the covering of the second compositional unit is not connected to the covering of the third compositional unit.

14. The structure of claim 13, wherein the second material comprises a textile, wherein each covering is held in proximity to a corresponding core by being attached to the corresponding core, and wherein at least one of the first and second fasteners comprises thread or a thread-like substance.

15. The structure of claim 14, wherein the first material comprises polystyrene, wherein a core of each of the first, second and third compositional units is in the shape of at least one of an ellipsoid, an ovoid, a sphere, and a spheroid; wherein the second material comprises a textile comprising a piece of clothing; wherein at least two coverings are held in proximity to corresponding cores by pinning; and wherein at least one of the first and second fasteners comprises thread or dental floss.

16. The structure of claim 13, further comprising:

a fourth compositional unit, the fourth compositional unit being adjacent to the second compositional unit, wherein a covering of the fourth compositional unit does not touch the covering of the second compositional unit.

17. The structure of claim 16, further comprising a third fastener for connecting the fourth compositional unit to the second compositional unit.

18. The structure of claim 13, wherein the first and second fasteners are different types of fastener.

19. The structure of claim 13, wherein the covering of the first compositional unit is connected to the covering of the second compositional unit via the first fastener and the covering of the first compositional unit is connected to the covering of the third compositional unit via the second fastener.

* * * * *